US005353684A

United States Patent [19]

Schwing

[11] Patent Number: 5,353,684

[45] Date of Patent: Oct. 11, 1994

[54] HYDRAULIC CONTROL DEVICE FOR WORKING CYLINDERS WITH UNEQUAL PISTON SPEEDS

[75] Inventor: Friedrich Schwing, Gelsenkirchen, Fed. Rep. of Germany

[73] Assignee: Friedrich Wilh, Schwing, GmbH, Herne, Fed. Rep. of Germany

[21] Appl. No.: 29,796

[22] Filed: Mar. 11, 1993

[30] Foreign Application Priority Data

Mar. 19, 1992 [DE] Fed. Rep. of Germany ..... 4208755

[51] Int. Cl.[5] ..... F15B 11/08; F15B 13/04

[52] U.S. Cl. ..... 91/446; 91/448; 91/461; 91/462

[58] Field of Search ..... 91/420, 421, 444, 445, 91/446, 448, 461, 462, 463, 464, 466

[56] References Cited

U.S. PATENT DOCUMENTS

| | | | |
|---|---|---|---|
| 3,763,746 | 10/1973 | Walters | 91/461 X |
| 3,835,647 | 5/1974 | Huffman . | |
| 3,872,773 | 3/1975 | Denker | 91/461 X |
| 3,903,786 | 9/1975 | Walters | 91/461 X |
| 3,973,747 | 8/1976 | Jagerstrom . | |
| 4,919,039 | 4/1990 | Nutter | 91/461 X |
| 4,933,617 | 6/1990 | Huber et al. | 91/461 X |

FOREIGN PATENT DOCUMENTS

| | | | |
|---|---|---|---|
| 0505977 | 9/1932 | European Pat. Off. . | |
| 0292457 | 11/1988 | European Pat. Off. . | |
| 2009340 | 9/1971 | Fed. Rep. of Germany . | |
| 2107324 | 8/1972 | Fed. Rep. of Germany . | |
| 2262450 | 8/1973 | Fed. Rep. of Germany . | |
| 2449736 | 4/1975 | Fed. Rep. of Germany . | |
| 2181479 | 12/1973 | France . | |
| 63-0321543 | 12/1988 | Japan . | |
| 2-0094596 | 9/1990 | Japan . | |
| 393485 | 7/1974 | U.S.S.R. | 91/461 |
| 830016 | 5/1981 | U.S.S.R. | 91/461 |
| 1038627 | 8/1983 | U.S.S.R. | 91/461 |

*Primary Examiner*—Edward K. Look
*Assistant Examiner*—Hoang Nguyen
*Attorney, Agent, or Firm*—Kinney & Lange

[57] ABSTRACT

In a hydraulic slide valve control for working cylinders with unequal piston speeds, in which the volume stream of the hydraulic working medium that loads the piston is adjusted to the prevailing piston speed and the direction of motion of the piston is set with a pilot-operated distribution valve, it is provided according to the invention that the redirecting valve (S3) is hydraulically pilot-operated with a pilot valve (A), which is adjustable by the control impulses for the working cylinder (1) and that between the pilot control paths (11, 12) from the pilot valve (A) to the redirecting valve (S3) a hydraulically pilot-operated control valve (B) is installed, through which runs one of the two volume streams of the hydraulic working medium, where a piston speed is assigned to each position of the control valve (B).

5 Claims, 1 Drawing Sheet

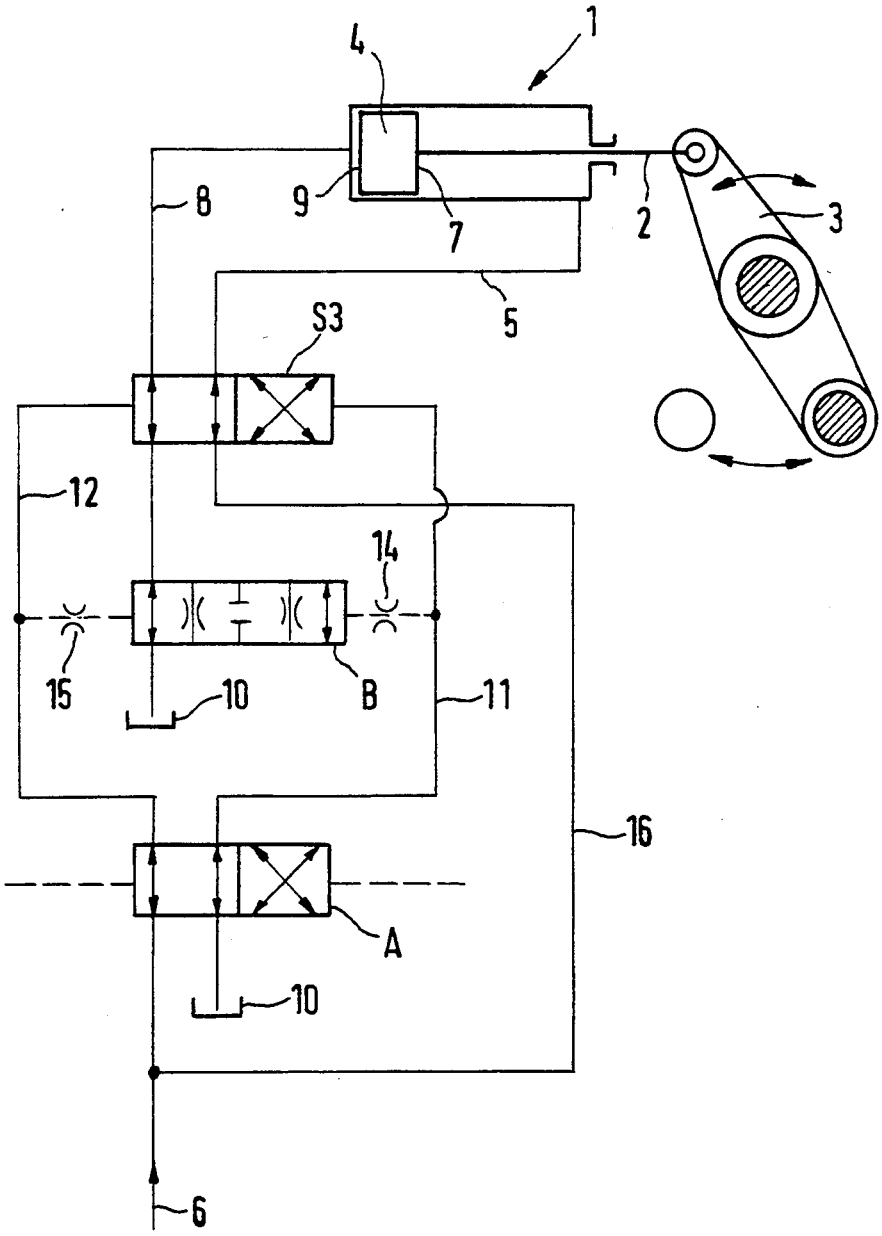
1
4
9
7
8
2
3
5
S3
12
14
15
10
B
11
16
A
10
6

HYDRAULIC CONTROL DEVICE FOR WORKING CYLINDERS WITH UNEQUAL PISTON SPEEDS

BACKGROUND OF THE INVENTION

The invention pertains to a hydraulic slide valve control for working cylinders.

Hydraulic working cylinders are primarily used in mechanical engineering for the conveyance of kinetic energy in two opposite directions. This allows the back-and-forth motion of movable parts. The kinetic energy of such a hydraulic drive depends on the volume stream of the hydraulic medium that is directed to the respective side of the piston in the hydraulic cylinder. While in general the piston develops an essentially uniform speed in the back-and-forth travel in the hydraulic working cylinder, the invention provides that the piston is propelled over at least one of its paths at varying speeds. This satisfies practical requirements putting varying demands on the hydraulic drive. For example, it may be important to start the motion at a slow speed, then accelerate it in the medium range, and to slow it down again at the end of the motion. Another requirement consists of starting the motion at a high speed, slowing it down toward midrange and, if so required, bring it to a short halt, and then to accelerate it again at the end. These are only examples. In actual application a multitude of other combinations of motion courses may be required, for which in freely selectable sequence, the piston must be accelerated and delayed.

Such hydraulic working cylinders are known in principle. One of the known design forms provides for a volume control of the hydraulic volume stream, that corresponds to the respective piston speed in the working cylinder, through the hydraulic pressure generator. This requires as a rule volume adjustable pumps where, e.g., for a variable axial piston pump, the slope of the control level determines the respective volume stream. Such pumps are relatively costly. Furthermore, it is not always possible to provide such controlled pumps for the working cylinder. If such pumps are necessary in a control loop from which the control loop of the hydraulic working cylinder branches off, one may often not be able to directly realize varying piston speeds.

SUMMARY OF THE INVENTION

Another known possibility to drive a machine or a machine element with a working cylinder in one direction of motion with varying speeds, consists of inserting a mechanical transmission in the delivery of the kinetic energy. For this, especially lever drives/transmissions may be considered. Such transmissions are relatively elaborate and also require space that cannot always be provided.

The invention is based on the aforementioned possibility of the control of the piston speed through the volume stream that loads the drive piston, where the switching of the direction of motion is effected by a pilot-operated distribution valve. However, the volume stream follows a different path.

According to the invention, the pilot control of the redirecting distribution valve occurs with a pilot control valve that directs hydraulic medium to one or the other side of the valve piston and such creates the respective switch condition that is determined by the primary control. The piston speed is determined by the control of a control valve, the piston of which can assume any position with corresponding control ports, but where the number of possible positions is fitted to the individual case, and therewith directly influences in each position one of the volume streams. This control valve is situated with both sides of its valve piston in one control line of the pilot control each and thereby is itself pilot-controlled. Thereby can the control condition desired in each case be hydraulically created and does in each case control one of the piston speeds.

The invention has the advantage that in a simple fashion, i.e. especially without use of the hydraulic pressure generator, but by hydraulic means, varying working speeds become possible with a linear drive in form of a hydraulic working cylinder. This includes also the possibility to stop the piston of the working cylinder.

Preferentially, several piston speeds may be set one after the other. The throttles required for this, installed in the pilot control paths of the pilot valve, represent simple means which may easily be realized in hydraulic circuits.

A retaining block is provided in the path assigned to at least one position of the control valve to stop the piston in its path on demand.

A reservoir is provided as a pressure generator for the linear drive of a hydraulic working cylinder. The reservoir has, compared to a hydraulic pump with constant discharge volume the advantage that the differential volume between the load volume for the working cylinder determined by the control orifices and the volume made available by the pressure generator need not be conveyed to the tank in a heat-generating manner through a safety valve.

BRIEF DESCRIPTION OF THE DRAWING

The drawing depicts an example of execution of the invention. The drawing shows the slide valve control in symbols, while the hydraulic working cylinder 1 and the machine part in form of a two-armed rocker 3, driven by its piston rod 2, are schematically depicted. The piston 4 runs in the hydraulic working cylinder 1. A line 5 loads with a volume stream of the hydraulic pressure generator indicated at 6 (pump or reservoir) the piston rod side 7 of the working cylinder 4, while the piston side 9 of the piston 4 in the working cylinder 1 is loaded through the line 8.

DETAILED DESCRIPTION OF THE PREFERRED EMBODIMENTS

The redirecting valve S3 is a 4/2 distribution valve of known design and allows the loading of each piston side with the hydraulic fluid stream, while simultaneously the opposite piston side is switched pressureless to the hydraulic fluid tank 10. The example of execution shows the piston side 9 switched to the hydraulic fluid tank 10.

A pilot valve A that may be loaded on both sides of its valve piston by a primary control with switch impulses, serves for the control of both pilot control paths 11, 12 of the redirecting valve S3. This pilot valve is essentially like the redirecting valve S3, but it may also be switched electrically or electronically. Although the tank appears twice in the drawing, it may actually be the same tank in practice into which the discharged volume stream from the pilot control paths 11, 12 is fed.

A third distribution valve in form of a pilot-operated control valve B is installed between the pilot valve A and the redirecting valve S3. It is also hydraulically pilot-controlled. This occurs from the pilot control paths 11, 12 through throttles 14, 15. The valve piston of the control valve B according to the example of execution contains five paths. Two paths switch the discharge from the working cylinder to the tank. Two paths situated in-between contain throttles with equal or varying throttling effects, while the middle path blocks the discharged volume stream.

In the circuit, the arrangement is made such that the volume stream replaced by the piston side 9 runs through the line 8 through the control valve B, while the piston rod side 7 is connected through line 5 and a bypass 16 to the hydraulic pressure generator 6.

In operation, the throttle 14 acts upon the pressureless side of the valve piston in control valve B. The throttle 15 determines the respective position of the valve piston, where the valve piston runs in succession through all switch paths. Thereby, the drive piston 4 is driven at varying speed and stopped in the middle position. The rocker 3 of the (hinged) lever transmission does, therefore, execute a sequence of motions over the effective path indicated by the double arrows.

If the redirecting valve S3 is switched over, the piston of the control valve B returns to its starting position and therewith can again execute various motion sequences.

What is claimed is:

1. A hydraulic control device comprising:

a working cylinder having a piston end and a rod end, a piston movable in the working cylinder between the piston end and the rod end, a piston rod attached to the piston and extending from the rod end of the working cylinder, the piston being movable by a volume of hydraulic medium in the working cylinder acting on the piston;

a hydraulically pilot-operated redirecting valve for redirecting the flow of the hydraulic medium in the working cylinder for controlling the direction of movement of the piston;

a pilot valve for operating the redirecting valve, the pilot valve being operatively connected to the redirecting valve through pilot control paths; and a hydraulically pilot-operated control valve positioned between the pilot control paths for controlling the volume of hydraulic medium flowing into and out of the working cylinder, the hydraulic medium flowing through selected positions of the control valve such that the speed of the piston is adjusted by the position of the control valve, each position of the control valve having a piston speed associated therewith.

2. The hydraulic control device according to claim 1, further comprising throttles placed in the pilot control paths for the hydraulic pilot control of the control valve.

3. The hydraulic control device of claim 1, further comprising a retaining lock positioned in the path assigned to at least one position of the control valve.

4. The hydraulic control device of claim 1, wherein the positions of the control valve contains a sequence of drilled passages, throttle ports and retaining blocks.

5. The hydraulic control device of claim 1, further comprising a reservoir for the pressure generator of the hydraulic working cylinder.

* * * * *

UNITED STATES PATENT AND TRADEMARK OFFICE

CERTIFICATE OF CORRECTION

PATENT NO. : 5,353,684

DATED : October 11, 1994

INVENTOR(S) : FRIEDRICH SCHWING

It is certified that error appears in the above-indentified patent and that said Letters Patent is hereby corrected as shown below:

Col. 2, line 27, after "discharge volume", insert ",".

Signed and Sealed this

Twenty-eight Day of March, 1995

*Attest:*

*Attesting Officer*

BRUCE LEHMAN

*Commissioner of Patents and Trademarks*